US012077399B2

(12) United States Patent
Nishimura et al.

(10) Patent No.: US 12,077,399 B2
(45) Date of Patent: Sep. 3, 2024

(54) SHEET SUPPLYING APPARATUS

(71) Applicant: BROTHER KOGYO KABUSHIKI KAISHA, Nagoya (JP)

(72) Inventors: Shoichiro Nishimura, Yokkaichi (JP); Kouichi Sugimoto, Nagakute (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 225 days.

(21) Appl. No.: 17/685,669

(22) Filed: Mar. 3, 2022

(65) Prior Publication Data

US 2022/0281699 A1 Sep. 8, 2022

(30) Foreign Application Priority Data

Mar. 3, 2021 (JP) ..... 2021-033163

(51) Int. Cl.

| | |
|---|---|
| ***B65H 1/14*** | (2006.01) |
| ***B65H 1/04*** | (2006.01) |
| ***B65H 1/12*** | (2006.01) |
| ***B65H 1/24*** | (2006.01) |
| ***B65H 3/06*** | (2006.01) |

(52) U.S. Cl.

CPC ..... *B65H 1/14* (2013.01); *B65H 1/04* (2013.01); *B65H 1/12* (2013.01); *B65H 1/24* (2013.01); *B65H 3/06* (2013.01); *B65H 3/0661* (2013.01); *B65H 2405/1117* (2013.01); *B65H 2407/21* (2013.01); *B65H 2801/06* (2013.01)

(58) Field of Classification Search

CPC ... B65H 1/04; B65H 1/12; B65H 1/14; B65H 1/24; B65H 3/0661; B65H 2405/1117; B65H 2407/21

See application file for complete search history.

(56) References Cited

U.S. PATENT DOCUMENTS

| | | | | |
|---|---|---|---|---|
| 5,181,713 | A * | 1/1993 | Neugebauer | B65H 1/04 271/160 |
| 2005/0140081 | A1* | 6/2005 | Sugimura | B65H 1/04 271/118 |
| 2015/0061214 | A1* | 3/2015 | Woo | B65H 3/0607 271/160 |

(Continued)

FOREIGN PATENT DOCUMENTS

| | | |
|---|---|---|
| JP | 2019-147691 A | 9/2019 |
| JP | 2020-104973 A | 7/2020 |

*Primary Examiner* — Prasad V Gokhale

(74) *Attorney, Agent, or Firm* — Merchant & Gould P.C.

(57) ABSTRACT

A sheet supplying apparatus includes a supplying roller, a supply tray, and a lifting/lowering member having a protrusion. The pressure plate includes a pressure plate body and a contact member supported by the pressure plate body so as to be movable between a first position and a second position. The contact member is pushed up and lowered with the pressure plate body while being in contact with the protrusion at the first position in a state in which the protrusion is placed below the pressure plate body. The contact member moves to the second position at which the contact member is escaped from the lifting/lowering member when the protrusion moves from a position higher than the pressure plate toward a position lower than the pressure plate. The contact member moves to the first position when the lifting/lowering member moves to the position lower than the pressure plate.

15 Claims, 11 Drawing Sheets

(56) References Cited

U.S. PATENT DOCUMENTS

| | | | | |
|---|---|---|---|---|
| 2015/0115521 | A1* | 4/2015 | Ishida | B65H 7/02 271/153 |
| 2016/0122140 | A1 | 5/2016 | Furusawa | |
| 2016/0152426 | A1* | 6/2016 | Hosohara | B65H 1/12 271/117 |
| 2021/0171299 | A1* | 6/2021 | Mizumukai | B65H 3/0669 |

* cited by examiner

SHEET SUPPLYING APPARATUS

CROSS REFERENCE TO RELATED APPLICATION

The present application claims priority from Japanese Patent Application No. 2021-033163, which was filed on Mar. 3, 2021, the disclosure of which is herein incorporated by reference in its entirety.

BACKGROUND

The following disclosure relates to a sheet supplying apparatus.

There has been known a sheet supplying apparatus including a pickup roller, a MP tray, and a link member.

The pickup roller supplies sheets. The MP tray supports the sheets. The MP tray includes a pressure plate which is vertically movable between a supply position at which the uppermost sheet is caused to be brought into contact with the pickup roller and a non-supply position lower than the supply position.

A supported portion is integrally formed with the pressure plate. The link member is movable so that the pressure plate moves vertically in a state in which the like member is in contact with the supported portion of the pressure plate from below.

SUMMARY

Incidentally, in the above described sheet supplying apparatus, there is a possibility that a positional relationship in which the pressure plate is located upper than the link member is reversed when the pressure plate moves in an up and down direction, for example, in a case where the sheet jammed at the time of supplying is removed or in a case where operations are suddenly stopped at the time of supplying due to a power outage, and in other cases.

When the link member is tried to be moved from a position higher than the pressure plate to a position lower than the pressure plate for returning the positional relationship between the pressure plate and the link member to the original relationship, the link member and the supported portion of the pressure plate may interfere with each other. It may be difficult to return the positional relationship to the original relationship, and there is a possibility that the pressure plate or the link member is damaged in some cases.

The present disclosure has been made in view of the above circumstances, and an object thereof is to provide a sheet supplying apparatus capable of returning a positional relationship to an original relationship in which a pressure plate is located upper than a lifting/lowering member even when the relationship is reversed to thereby suppress damage of the pressure plate or the lifting/lowering member.

In one aspect of the disclosure, a sheet supplying apparatus includes a supplying roller configured to supply a sheet, a supply tray supporting the sheet and including a pressure plate movable between a supply position at which an uppermost sheet in the supply tray is caused to be brought into contact with the supplying roller and a non-supply position which is lower than the supply position, a lifting/lowering member having a gear and a protrusion protruding from the gear, the lifting/lowering member being configured to move so as to move the pressure plate in a state in which the protrusion of lifting/lowering member is in contact with the pressure plate from below. The pressure plate includes a pressure plate body supporting the sheet, and a contact member supported by the pressure plate body so as to be movable between a first position and a second position, the contact member being pushed up with the pressure plate body while being in contact with the protrusion of the lifting/lowering member at the first position when the protrusion of the lifting/lowering member is lifted for moving the pressure plate from the non-supply position to the supply position in a state in which the protrusion of the lifting/lowering member is placed below the pressure plate body, the contact member being lowered with the pressure plate body while being in contact with the protrusion of the lifting/lowering member at the first position when the lifting/lowering member is lowered for moving the pressure plate from the supply position to the non-supply position in the state in which the lifting/lowering member is placed below the pressure plate body. The contact member is configured to move to the second position at which the contact member is escaped from the lifting/lowering member in accordance with the contact with the protrusion of the lifting/lowering member when the protrusion of the lifting/lowering member moves from a position higher than the pressure plate toward a position lower than the pressure plate. The contact member is configured to move to the first position when the lifting/lowering member moves to the position lower than the pressure plate.

In another aspect of the disclosure, a sheet supplying apparatus includes a supplying roller configured to supply a sheet, a supply tray supporting the sheet and including a pressure plate movable between a supply position at which an uppermost sheet in the supply tray is caused to be brought into contact with the supplying roller and a non-supply position which is lower than the supply position, a gear, and a protrusion protruding from the gear, the protrusion being configured to move so as to move the pressure plate in a state in which the protrusion is in contact with the pressure plate from below. The pressure plate includes a pressure plate body supporting the sheet, a disk supported by the pressure plate body, a spring disposed between the pressure plate body and the disk, and an extending lever extending from the disk in a radial direction of the first axis so as to be movable between a first position and a second position, the spring being configured to urge the extending lever toward the first position, the extending lever being pushed up with the pressure plate body while being in contact with the protrusion at the first position when the protrusion is lifted for moving the pressure plate from the non-supply position to the supply position in a state in which the protrusion is placed below the pressure plate body, the extending lever being lowered with the pressure plate body while being in contact with the protrusion at the first position when the protrusion is lowered for moving the pressure plate from the supply position to the non-supply position in the state in which the protrusion is placed below the pressure plate body. The extending lever is configured to move to the second position at which the extending lever is escaped from the protrusion against the spring by being pushed by the protrusion when the protrusion moves from a position higher than the pressure plate toward a position lower than the pressure plate. The spring is configured to urge the extending lever to the first position when the protrusion moves to the position lower than the pressure plate.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Hereinafter, embodiments 1 and 2 obtained by embodying the present disclosure will be explained with reference to the drawings.

Embodiment 1

Figure 1:
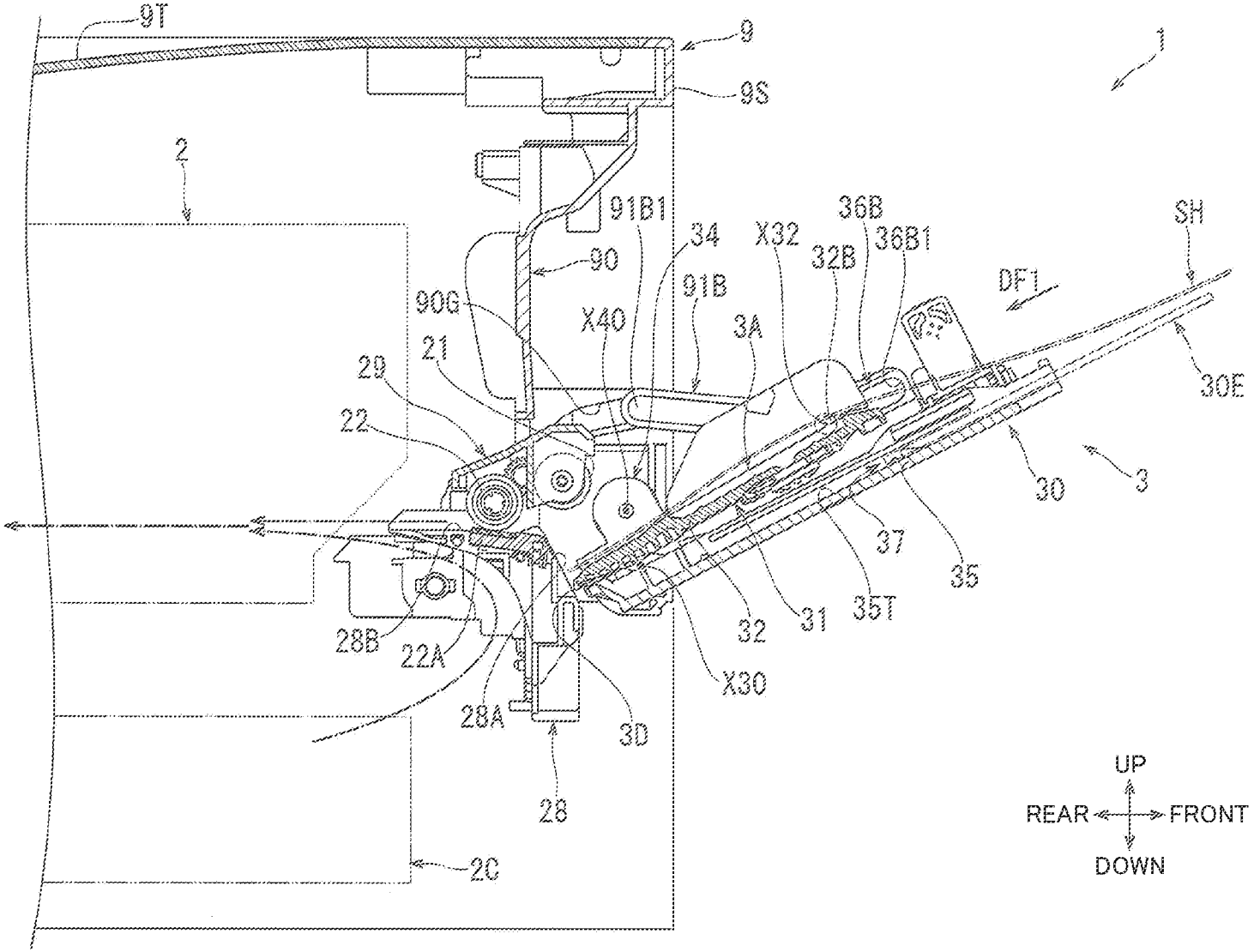
FIG. 1 is a partial cross-sectional view of an image forming apparatus according to Embodiment 1, which is a view chiefly illustrating a state in which a supplying tray is at an extended position and a pressure plate is at a non-supply position.

As illustrated in FIG. 1, an image forming apparatus 1 according to Embodiment 1 is an example of a specific embodiment of a sheet supplying apparatus according to the present disclosure. In FIG. 1, a front surface 9S side of a housing 9 is defined as a front side of the apparatus and an upper surface side of the housing 9 is defined as an upper side of the apparatus, and a front and rear direction and a up and down direction are defined. Then, the front and rear direction and the up and down direction illustrated in respective drawings in FIG. 2 and after will be displayed so as to correspond to FIG. 1.

Figure 2:
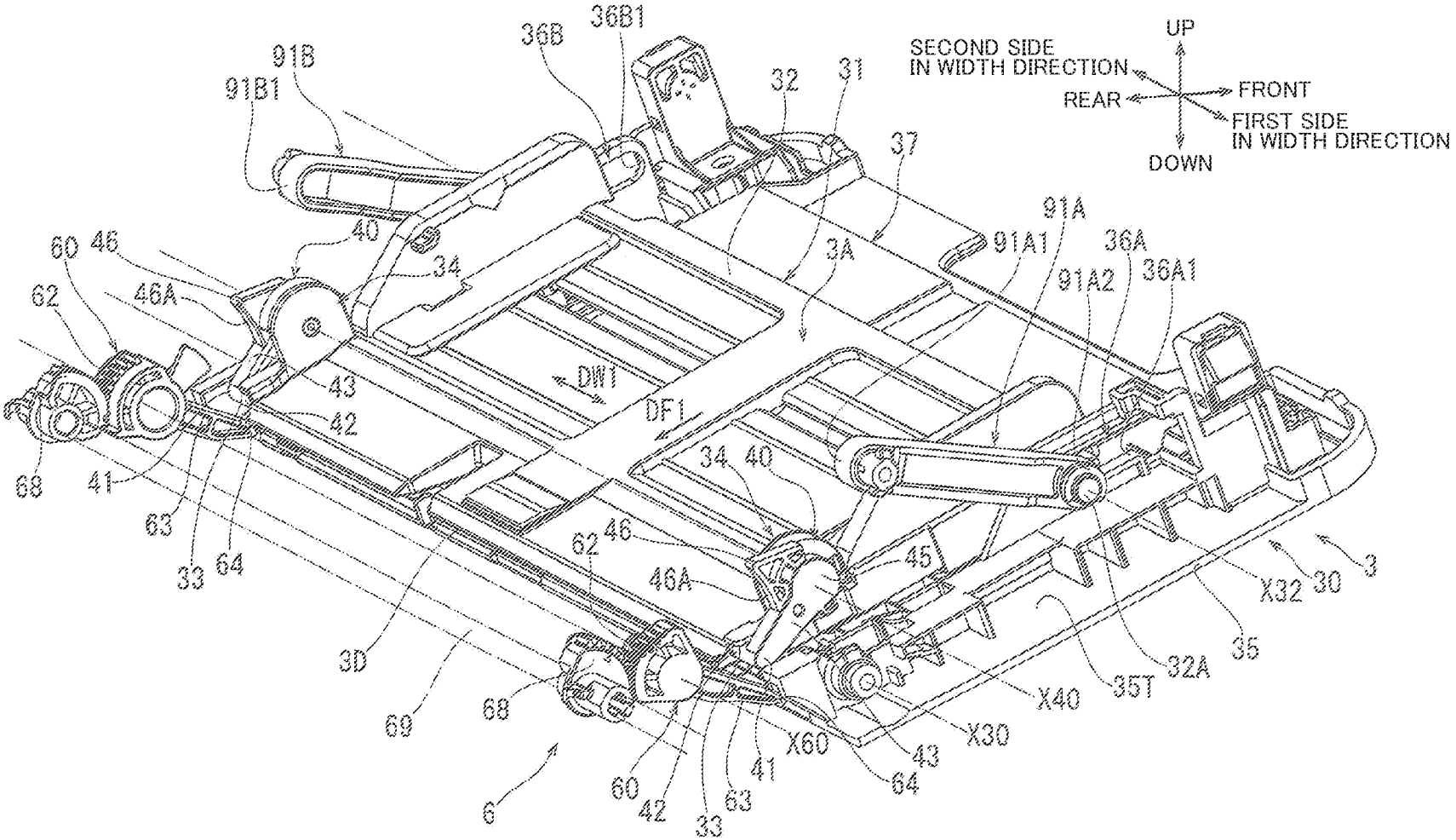
FIG. 2 is a perspective view of the supplying tray and lifting/lowering arms, which is a view chiefly illustrating the state in which the supplying tray is at the extended position and the pressure plate is at the non-supply position.

A width direction DW1 of a supplying tray 3 illustrated in FIG. 2 and the like is a direction orthogonal to the front and rear direction and the up and down direction. Moreover, a first side of the width direction DW1 illustrated in FIG. 2 and the like is a near side of the paper in FIG. 1.

As illustrated in FIG. 1, the image forming apparatus 1 includes the housing 9, a sheet-supplying cassette 2C, an image forming unit 2, and a not-illustrated conveying mechanism. The housing 9 is an approximately box-shaped body and has a discharge tray 9T on an upper surface thereof. The sheet-supplying cassette 2C is located at a lower part in the housing 9, and accommodates a plurality of sheets in a stacked state.

The image forming unit 2 is located at an upper part in the housing 9. The image forming unit 2 forms an image on the sheet by conventional image forming methods such as an electrophotographic method, a thermal head method, and an ink-jet method.

The not-illustrated conveying mechanism supplies sheets to the image forming unit 2 one by one from the sheet-supplying cassette 2C. The image is formed on the sheet by the image forming unit 2. After that, the not-illustrated conveying mechanism conveys the sheet on which the image is formed and discharges the sheet onto the discharge tray 9T.

The image forming apparatus 1 includes the supplying tray 3. The supplying tray 3 is a multi-purpose tray for supplying a plurality of kinds of sheets SH with different sizes, thicknesses and the like to the image forming unit 2.

The supplying tray 3 is located on the front surface 9S side of the housing 9. The supplying tray 3 is supported by the housing 9 so as to be pivotable between an extended position at which the supplying tray 3 extends forward from the front surface 9S and an accommodated position at which the supplying tray 3 stands along the front surface 9S of the housing 9. The front surface 9S of the housing 9 is an example of a "side surface of the housing" in the present disclosure.

Figure 3:
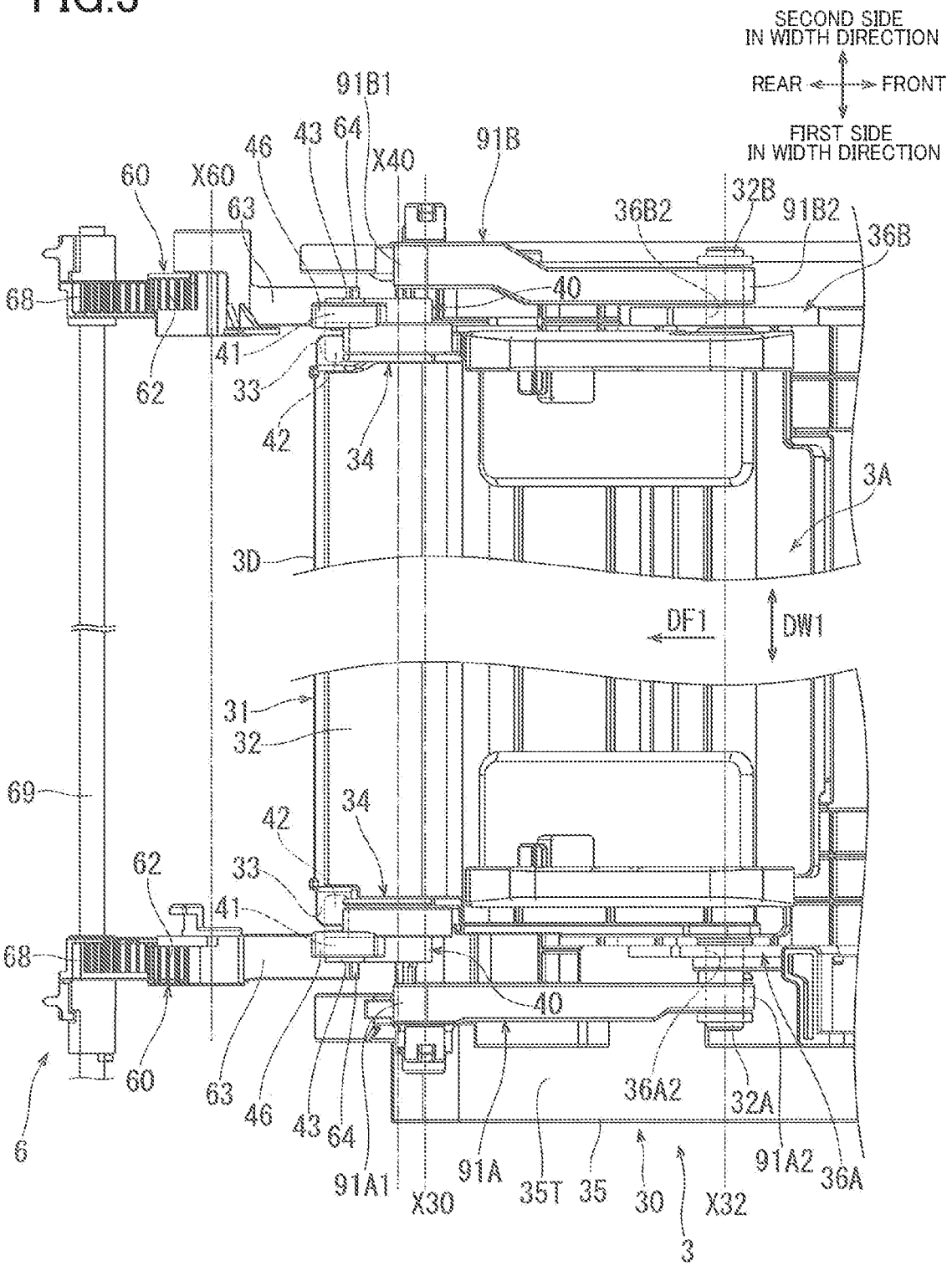
FIG. 3 is a partial top view of the supplying tray and the lifting/lowering arms, which is a view chiefly illustrating a state in which the supplying tray is at the extended position.

As illustrated in FIG. 1 to FIG. 3, a surface of the supplying tray 3 facing upward is a support surface 3A which can support the sheet SH in a state in which the supplying tray 3 is at the extended position. A supplying direction DF1 of the sheet SH supported on the support surface 3A is a direction orthogonal to the width direction DW1 of the supplying tray 3 and inclined downward in the rear direction.

When shapes or the like of a plurality of members constituting the supplying tray 3 are explained, the up and down direction and the front and rear direction are defined when a posture of the supplying tray 3 is in the extended position as a reference.

As illustrated in FIG. 1, the housing 9 includes a supplying tray accommodating portion 90. The supplying tray accommodating portion 90 is recessed from an upper portion of the front surface 9S in the rear direction. An inner wall located in a second side of the width direction DW1 in the supplying tray accommodating portion 90, namely, on a back side of the paper in FIG. 1 has an arm guide 90G having an approximately long hole shape. An inner wall located in the first side of the width direction DW1 in the supplying tray accommodating portion 90, namely, on the near side of the paper in FIG. 1 also has the arm guide 90G, which is not illustrated.

As illustrated in FIG. 2 and FIG. 3, the image forming apparatus 1 includes link arms 91A, 91B. A first end 91A1 of the link arm 91A has a shaft portion protruding toward the first side of the width direction DW1. A first end 91B1 of the link arm 91B has a shaft portion protruding toward the second side of the width direction DW1.

As illustrated in FIG. 1, the shaft portion of the first end 91B1 of the link arm 91B is inserted into the arm guide 90G of the supplying tray accommodating portion 90 to thereby be coupled to the housing 9. The first end 91A1 of the link arm 91A is also coupled to the housing 9 in the same manner, though not illustrated.

Supplying Roller, Separation Roller, Separation Pad

The housing 9 has a roller support member 29 located lower than the supplying tray accommodating portion 90 and a supplying guide member 28 located lower than the roller support member 29. The image forming apparatus 1 includes a supplying roller 21, a separation roller 22, and a separation pad 22A.

The roller support member 29 rotatably supports the supplying roller 21 and the separation roller 22. The roller support member 29 supports the supplying roller 21 and the separation roller 22 so that respective rotation axes of the supplying roller 21 and the separation roller 22 do not move. Lower portions of the supplying roller 21 and the separation roller 22 are exposed from a lower part of the roller support member 29.

The supplying roller 21 is located upper than the support surface 3A and upstream of a downstream end 3D on the support surface 3A in the supplying direction DF1. The separation roller 22 is located downstream of the downstream end 3D of the support surface 3A in the supplying direction DF1.

As illustrated in FIG. 1, the supplying guide member 28 has a regulation surface 28A and a supplying surface 28B. The regulation surface 28A is a surface facing frontward and extending in the width direction DW1. The regulation surface 28A is inclined so that an upper end thereof is located rearward of a lower end thereof. The regulation surface 28A is opposed to the downstream end 3D of the support surface 3A from a downstream side in the supplying direction DF1. The supplying surface 28B is a surface facing upward and connecting to an upper end of the regulation surface 28A. The supplying surface 28B extends toward a downstream side in the supplying direction DF1.

The regulation surface 28A stops a downstream end of the sheet SH supported by the support surface 3A in the supplying direction DF1 in a state in which the regulation surface 28A is in contact with the sheet SH. The supplying roller 21 supplies the uppermost sheet SH supported by the support surface 3A in the supplying direction DF1. The support surface 28B guides the sheet SH supplied by the supplying roller 21.

The supplying guide member 28 supports the separation pad 22A at a position right below the separation roller 22 so that the separation pad 22A is exposed from the supplying surface 28B. The separation pad 22A is pressed toward the separation roller 22.

The supplying roller 21, the separation roller 22, and the separation pad 22A described above supply the sheet SH supported by the support surface 3A to the image forming unit 2 one by one. The image is formed on the sheet SH by the image forming unit 2. After that, the not-illustrated conveying mechanism conveys the sheet SH on which the image is formed and discharges the sheet SH onto the discharge tray 9T.

Detailed Configuration of Supplying Tray

The supplying tray 3 includes a supplying tray body 30, a pressure plate 31 illustrated in FIG. 1 to FIG. 4, and a sub-tray 30E illustrated in FIG. 1 to FIG. 4.

As illustrated in FIG. 1, the housing 9 supports the supplying tray body 30 so as to be swingable about an opening/closing axis X30. The opening/closing axis X30 is located on a lower end side of the supplying tray accommodating portion 90 and extends in the width direction DW1.

As illustrated in FIG. 2 and FIG. 3, the supplying tray body 30 includes a flat plate portion 35, a link rails 36A, 36B, and a sub-tray accommodating portion 37.

The flat plate portion 35 extends so as to be gradually inclined upward from the opening/closing axis X30 side in the front direction and extends in the width direction DW1 in a state in which the supplying tray 3 is located at the extended position illustrated in FIG. 1 and the like.

Figure 4:
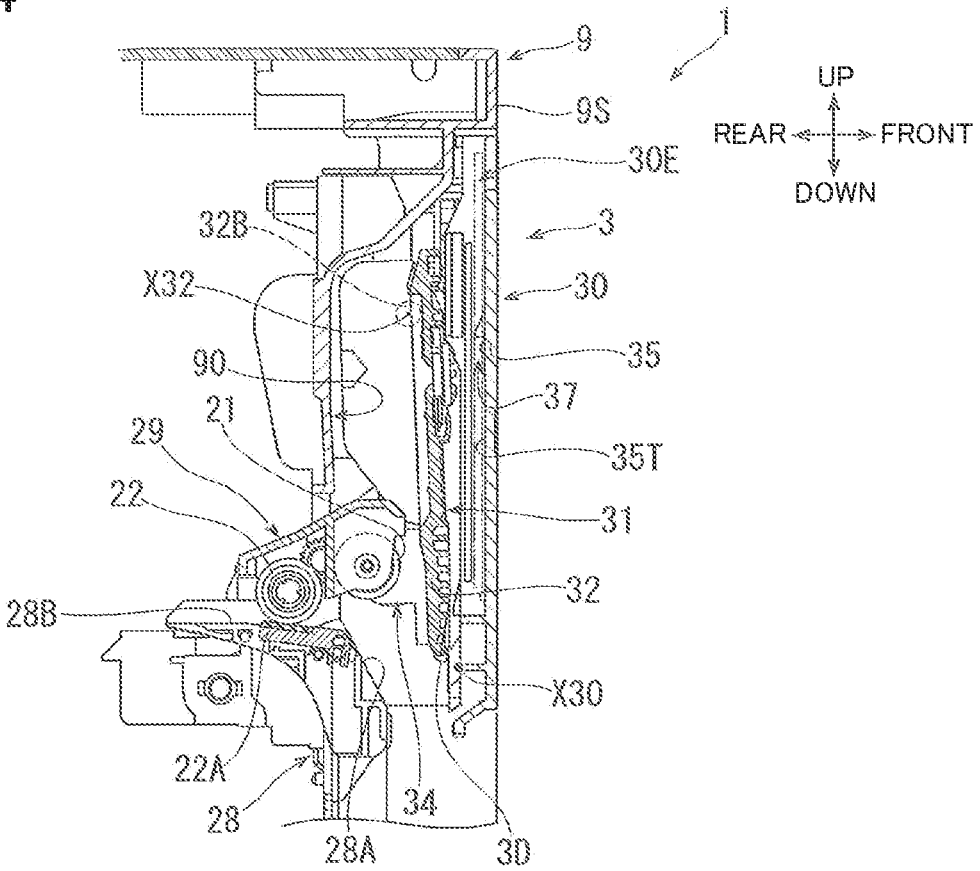
FIG. 4 is a partial cross-sectional view similar to FIG. 1, which is a view chiefly illustrating a state in which the supplying tray is at an accommodated position.

The flat plate portion 35 constitutes a part of a design surface of the housing 9 so that an exterior surface facing frontward is flush with the front surface 9S in a state in which the supplying tray 3 is located at the accommodated position illustrated in FIG. 4. A surface located on the opposite side to the exterior surface of the flat plate portion 35 is an inner surface 35T.

As illustrated in FIG. 1 to FIG. 3, the link rails 36A, 36B are located at both ends of the inner surface 35T of the flat plate portion 35 in the width direction DW1. The link rails 36A, 36B protrude upward and extend in the supplying direction DF1.

As illustrated in FIG. 2, the link rail 36A has a groove extending from a first rail end 36A1 along the supplying direction DF1. The link rail 36B has a groove extending from a first rail end 36B1 along the supplying direction DF1.

As illustrated in FIG. 3, the groove of the link rail 36A extends to a second rail end 36A2 located on an opposite side to the first rail end 36A1. The groove of the link rail 36B extends to a second rail end 36B2 located on an opposite side to the first rail end 36B1.

As illustrated in FIG. 2, the sub-tray accommodating portion 37 is located inside the link rails 36A, 36B in the width direction DW1 on the inner surface 35T side of the flat plate portion 35.

As illustrated in FIG. 4, the sub-tray accommodating portion 37 accommodates the sub-tray 30E in the state in which the supplying tray 3 is located at the accommodated position.

As illustrated in FIG. 1, the sub-tray 30E constitutes a part of an upstream side of the support surface 3A in the supplying direction DF1 so that the sub-tray 30E slides in the front direction in the state in which the supplying tray 3 is located at the extended position.

As illustrated in FIG. 2 and FIG. 3, the pressure plate 31 has a pressure plate body 32 and contact members 40. That is, the pressure plate 31 is divided into a plurality of parts.

Pressure Plate Body

The pressure plate body 32 is located on the inner surface 35T side of the supplying tray body 30. The pressure plate body 32 is an approximately flat plate member extending in the supplying direction DF1 and the width direction DW1. The pressure plate body 32 includes pivoting shafts 32A, 32B.

Each of the pivoting shafts 32A, 32B is located at an upstream end of the pressure plate body 32 in the supplying direction DF1 and protrudes from each of two corner portions, which are spaced apart from each other in the width direction DW1, toward each of outer sides in the width direction DW1. Each of the pivoting shafts 32A, 32B has a third axis X32 extending in the width direction DW1 as a center.

The pivoting shaft 32A is supported by a second end 91A2 of the link arm 91A so that the pivoting shaft 32A passes the groove of the link rail 36A and passes a shaft hole of the second end 91A2 of the link arm 91A.

The pivoting shaft 32B is supported by a second end 91B2 of the link arm 91B so that the pivoting shaft 32B passes the groove of the link rail 36B and passes a shaft hole of the second end 91B2 of the link arm 91B.

The pivoting shafts 32A, 32B are guided by the grooves of the link rails 36A, 36B so as to be slidable between the first rail ends 36A1, 36B1 and the second rail ends 36A2, 36B2 in the link rails 36A, 36B.

Figure 5:
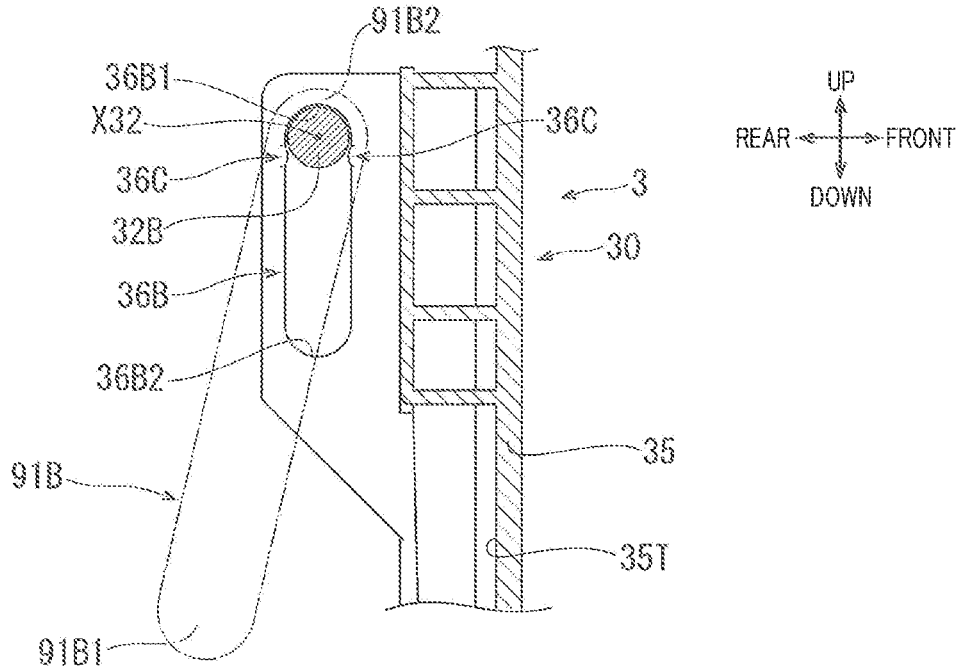
FIG. 5 is a partial cross-sectional view illustrating a state in which the supplying tray is at the accommodated position and a pivoting shaft of a pressure plate body is guided to a first rail end of a link rail, which is a view for explaining an operation of drawing-shape portions in the link rail.

As illustrated in FIG. 5, the link rail 36B has drawing-shape portions 36C. The drawing-shape portions 36C are located on the first rail end 36B1 side. The drawing-shape portions 36C swell from two opposed sides of the groove of the link rail 36B so as to come close to each other.

The drawing-shape portions 36C locally narrow an inner width of the groove of the link rail 36B at a position near the pivoting shaft 32B which has been guided to the first rail end 36B1. Accordingly, the drawing-shape portions 36C of the link rail 36B give resistance to the pivoting shaft 32B which moves from the first rail end 36B1 to the second rail end 36B2.

The link rail 36A also has the drawing-shape portions 36C in the same manner as the link rail 36B though not illustrated. The drawing-shape portions 36C of the link rail 36A give resistance to the pivoting shaft 32A which moves from the first rail end 36A1 toward the second rail end 36A2.

According to the above configuration, in the state in which the supplying tray 3 is located at the accommodated position illustrated in FIG. 4, the pivoting shaft 32B is guided to the first rail end 36B1 of the link rail 36B as illustrated in FIG. 5 and the pivoting shaft 32A is guided to the first rail end 36A1 of the link rail 36A though not illustrated so that the supplying tray 3 stands along the front surface 9S of the housing 9.

In the state in which the supplying tray 3 is located at the extended position illustrated in FIG. 1 and the like, the pivoting shafts 32A, 32B are guided to the second rail ends 36A2, 36B2 of the link rails 36A, 36B as illustrated in FIG. 3 so that the supplying tray 3 can support the sheet SH by extending frontward from the front surface 9S of the housing 9 as illustrated in FIG. 1.

An upper surface of the pressure plate body 32 constitutes a part of the support surface 3A including the downstream end 3D in this state and supports the sheet SH.

Figure 6:
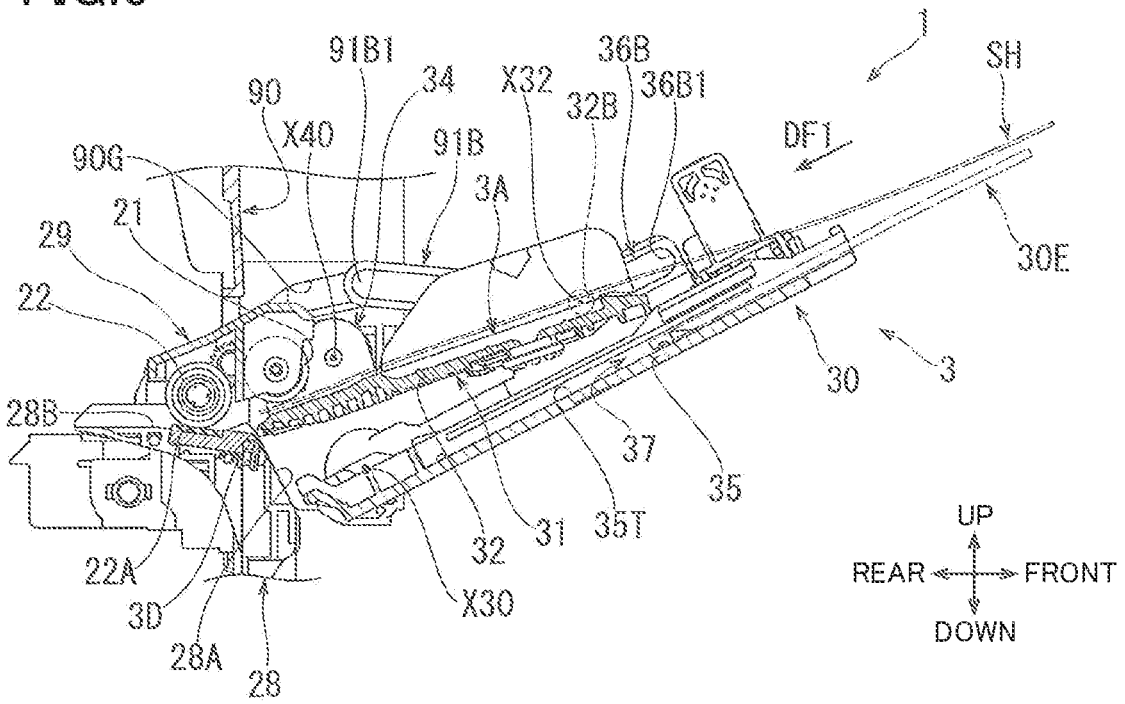
FIG. 6 is a partial cross-sectional view similar to FIG. 1, which is a view chiefly illustrating a state in which the supplying tray is at the extended position and the pressure plate is at a supply position.

Then, the pressure plate 31 can move in the up and down direction between a supply position at which the uppermost sheet SH is caused to be brought into contact with the supplying roller 21 illustrated in FIG. 6 and a non-supply position lower than the supply position illustrated in FIG. 1 when the pressure plate body 32 pivots about the third axis X32.

Figure 7:
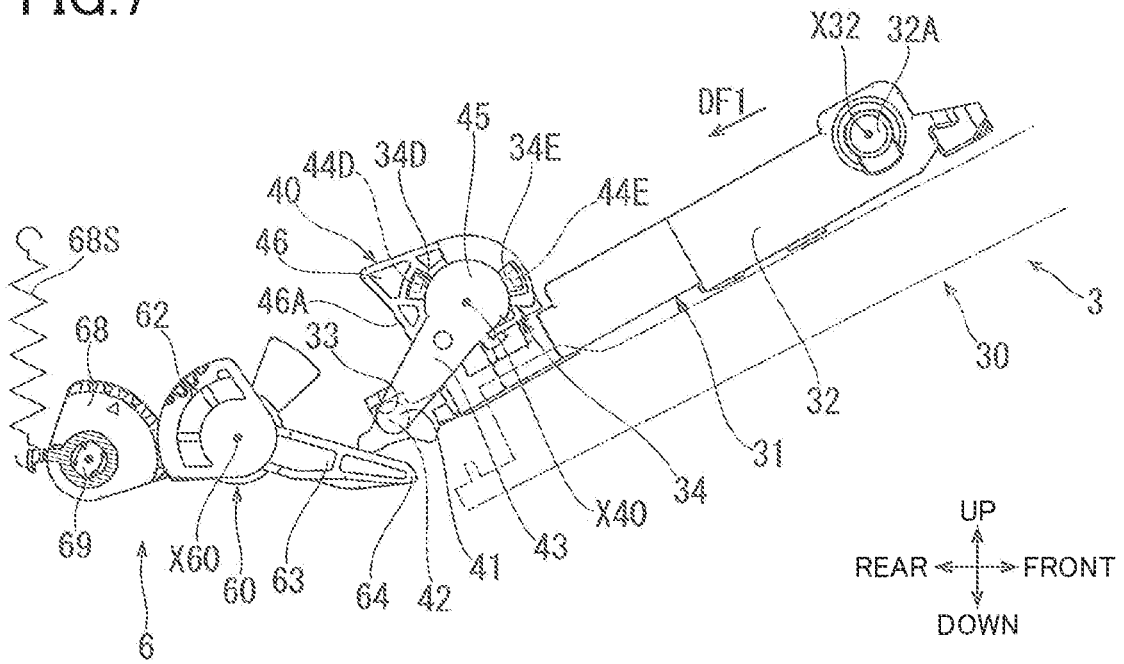
FIG. 7 is a side view illustrating the pressure plate body, a contact member, and the lifting/lowering arm, which is a view chiefly illustrating the state in which the pressure plate is at the non-supply position.
Figure 8:
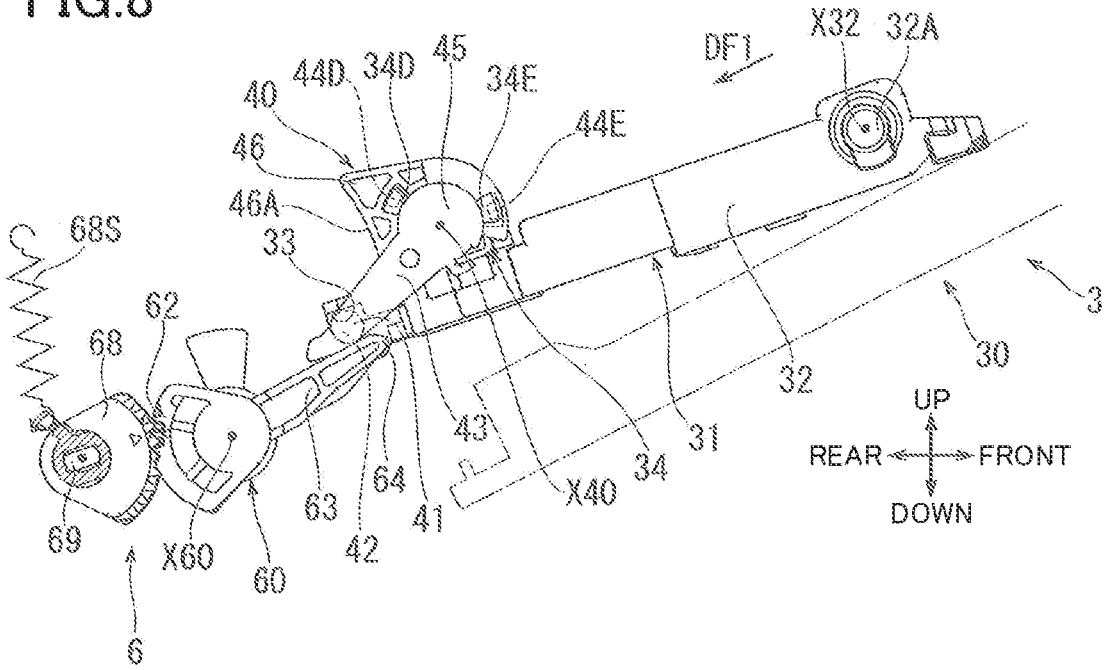
FIG. 8 is a side view similar to FIG. 7, which is a view chiefly illustrating the state in which the pressure plate is at the supply position.
Figure 9:
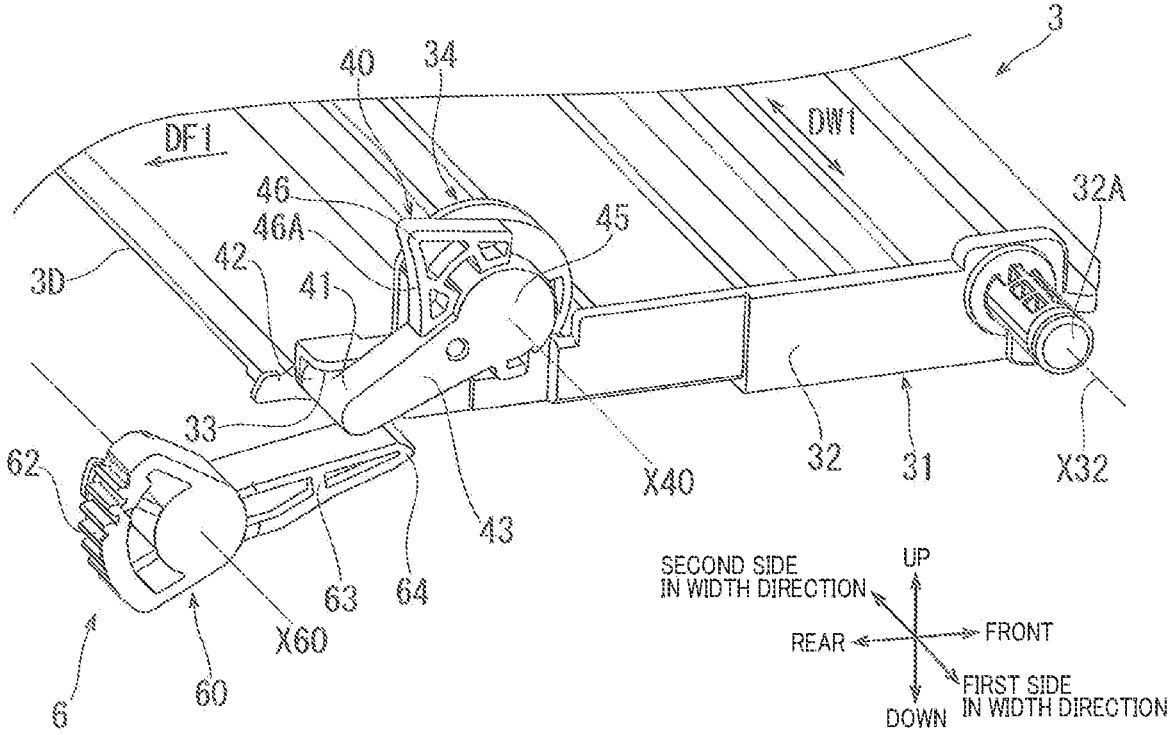
FIG. 9 is a partial perspective view illustrating the pressure plate body, the contact member, and the lifting/lowering arm, which is a view chiefly illustrating the state in which the pressure plate is at the supply position.
Figure 12:
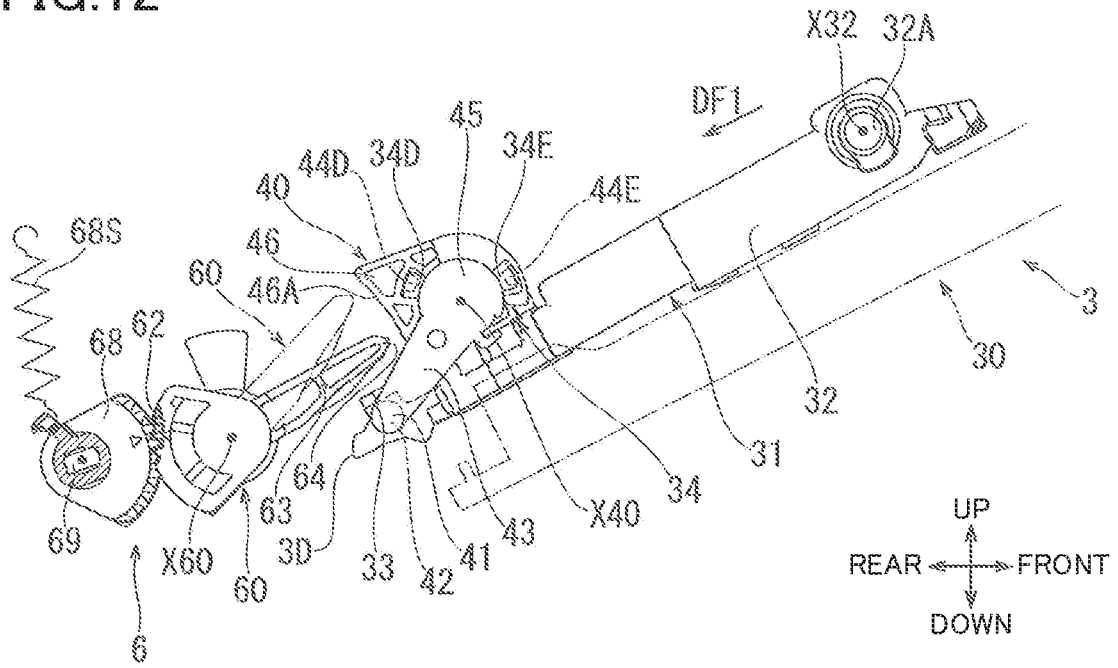
FIG. 12 is a side view similar to FIG. 7, which is a view illustrating a state in which a positional relationship in which the pressure plate is located upper than the lifting/lowering arm has been reversed.
Figure 13:
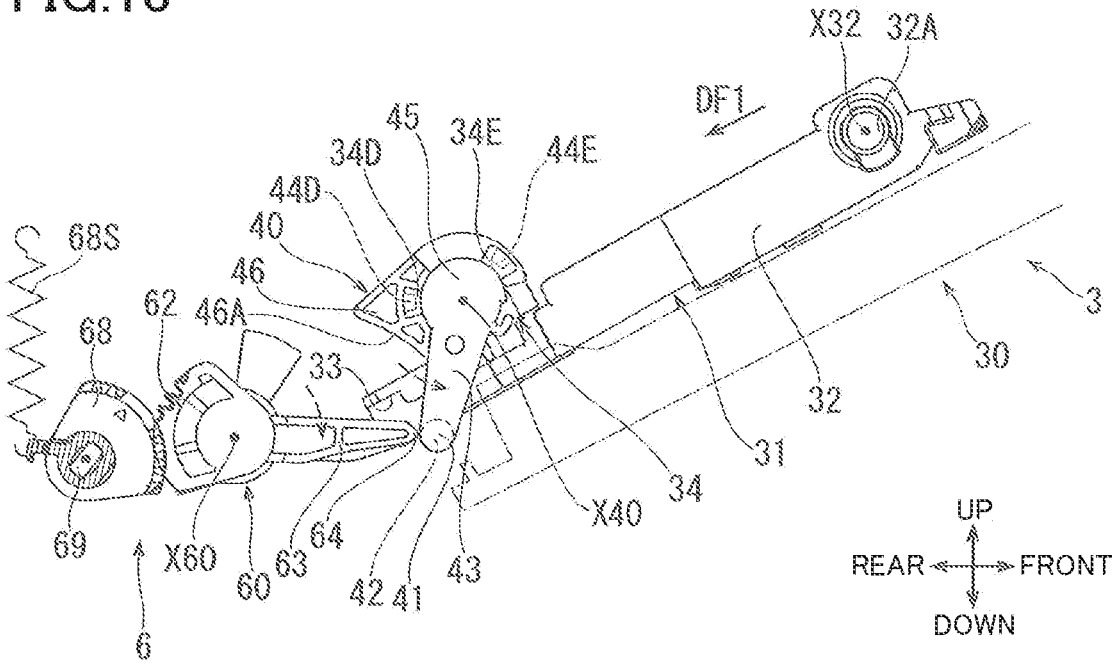
FIG. 13 is a side view similar to FIG. 7, which is a view illustrating a state in which the lifting/lowering arm is lowered from the state in which the positional relationship in which the pressure plate is located upper than the lifting/lowering arm is reversed and the contact member is swung to a second position in accordance with a contact with the lifting/lowering arm.

The position of the pressure plate body 32 illustrated in FIG. 7, FIG. 12, and FIG. 13 is the non-supply position. The position of the pressure plate body 32 illustrated in FIG. 8 and FIG. 9 is the supply position.

As illustrated in FIG. 2 and FIG. 3, the pressure plate body 32 includes two pairs of contacted portions 33 and support portions 34.

The contacted portion 33 and the support portion 34 in a first pair of the two pairs are integrated or integrally formed with the pressure plate body 32 at a corner portion located a downstream end of the pressure plate body 32 in the supplying direction DF1 and on the first side of the width direction DW1.

The contacted portion 33 and the support portion 34 in a second pair of the two pairs are integrated or integrally formed with the pressure plate body 32 at a corner portion located at a downstream end of the pressure plate body 32 in the supplying direction DF1 and on the second side of the width direction DW1.

The contacted portion 33 and the support portion 34 in the first pair and the contacted portion 33 and the support portion 34 in the second pair have the same configuration and disposed symmetrically opposite to each other. Accordingly, the configuration of the contacted portion 33 and the support portion 34 in first pair will be explained in detail, and explanation for the contacted portion 33 and the support portion 34 in the second pair is omitted.

Figure 10:
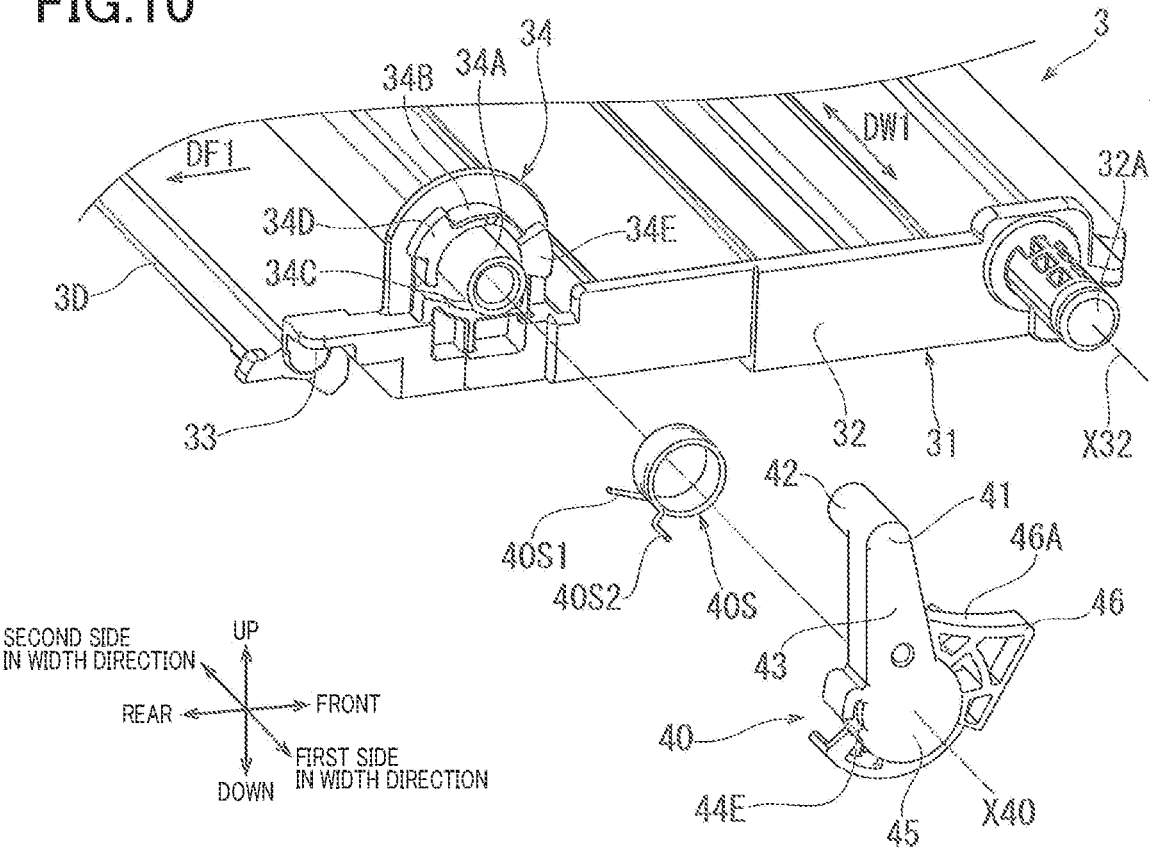
FIG. 10 is an exploded perspective view of the pressure plate body, a torsion coil spring, and the contact member, which is a view illustrating a posture of the contact member before assembled to the pressure plate body.

As illustrated in FIG. 10, the contacted portion 33 is a portion recessed upward at a distal end of the corner portion of the pressure plate body 32. The contacted portion 33 opens to the first side of the width direction DW1 and opens to the downstream side in the supplying direction DS1.

The support portion 34 protrudes upward from a first end edge of the pressure plate body 32 in the width direction DW1 on the upstream side of the contacted portion 33 in the supplying direction DF1. The support portion 34 includes a support shaft 34A, a cylindrical portion 34B, a slit 34C and stopper pieces 34D, 34E.

The support shaft 34A is a column protruding from an intermediate part of the support portion 34 in the up and down direction toward the first side of the width direction DW1. The support shaft 34A has a first axis X40 extending in the width direction DW1 as a center.

The cylindrical portion 34B is a cylinder surrounding the support shaft 34A around the first axis X40 and protruding shortly from the support portion 34 toward the first side of the width direction DW1.

The slit 34C is formed so that a part of the cylinder portion 34B close to the contacted portion 33 is cut out. The stopper pieces 34D, 34E are small pieces protruding, in a radial outer direction of the first axis X40, from two places which are spaced apart from each other at tip edges of the cylindrical portion 34B.

Contact Member and Torsion Coil Spring

As illustrated in FIG. 2 and FIG. 3, the pressure plate 31 has the two contact members 40. The contact member 40 located on the first side of the width direction DW1 and the contact member 40 located on the second side of the width direction DW1 have the same configuration and disposed symmetrically opposite to each other. Accordingly, the configuration of the contact member 40 located on the first side of the width direction DW1 will be explained in detail, and explanation for the contact member 40 located on the second side of the width direction DW1 is omitted.

The pressure plate 31 includes a torsion coil spring 40S located on the first side of the width direction DW1 as illustrated in FIG. 10 and a torsion coil spring 40S located on the second side of the width direction DW1 though not illustrated. The torsion coil spring 40S is an example of a "first urging member" according to the present disclosure.

The torsion coil spring 40S located on the first side of the width direction DW1 and the torsion coil spring 40S located on the second side of the width direction DW1 have the same configuration and disposed symmetrically opposite to each other. Accordingly, explanation for the torsion coil spring 40S located on the second side of the width direction DW1 is omitted.

The torsion coil spring 40S is disposed between the support portion 34 of the pressure plate body 32 and the contact member 40. More specifically, the torsion coil spring 40S is mounted on the support portion 34 so as to be surrounded by the cylindrical portion 34B in a state in which a coil portion of the torsion coil spring 40S is inserted from the outside into the support shaft 34A.

In the above state, the slit 34C engages with a first end portion 40S1 of the torsion coil spring 40S. A second end portion 40S2 of the torsion coil spring 40S protrudes toward the first side of the width direction DW1.

The contact member 40 is supported by the pressure plate body 32 so as to be swingable about the first axis X40. More specifically, the contact member 40 has a supported portion 45, an extending portion 43, a first contact portion 41, a second contact portion 42, and a guiding portion 46. The extending portion 43 is an example of an "extending lever" according to the present disclosure. The supported portion 45 is an example of a "disk" according to the present disclosure.

Figure 11A:
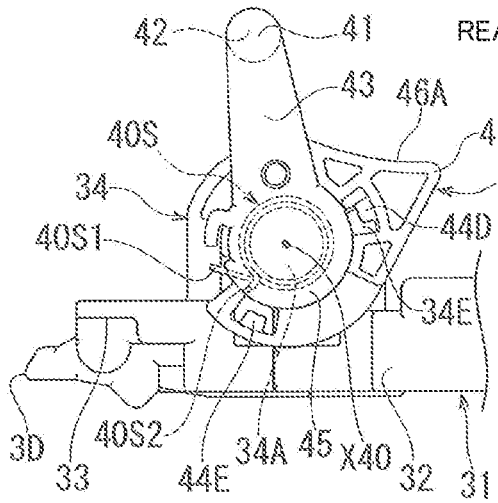
FIG. 11A is a partial side view for explaining a procedure for assembling the contact member to the pressure plate body.
Figure 11B:
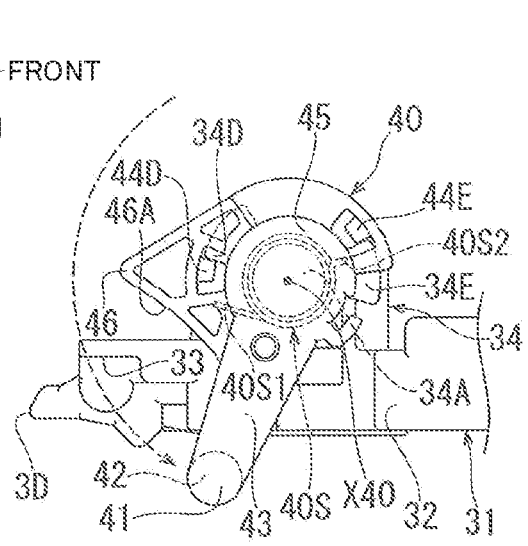
FIG. 11B is a partial side view for explaining a procedure for assembling the contact member to the pressure plate body.

As illustrated in FIG. 11A and FIG. 11B, the supported portion 45 is supported by the pressure plate body 32 so as to be swingable about the first axis X40 and engages with the second end portion 40S2 of the torsion coil spring 40S in a state in which the support shaft 34A of the pressure plate body 32 is inserted into the supported portion 45.

As illustrated in FIG. 10, the extending portion 43 extends from the supported portion 45 in a radial outer direction of the first axis X40. The first contact portion 41 is located on a distal end side of the extending portion 43. A distal end of the first contact portion 41 has a semicircular shape when viewed from the width direction DW1. The second contact portion 42 is a column adjacent to the first contact portion 41 on the distal end side of the extending portion 43 and protruding toward the second side of the width direction DW1, namely, the pressure plate body 32 side.

The guiding portion 46 is a part of an outer flange connected to the contacted portion 45, and protrudes in the radial outer direction of the first axis X40. The guiding portion 46 has a guiding surface 46A. The guiding surface 46A gradually curves from an apex of the guiding portion 46 toward the extending portion 43.

As illustrated in FIGS. 11A and 11B, the contact member 40 has small pieces 44D, 44E. The small pieces 44D, 44E are connected to two places which are spaced apart from each other at the outer flange which is connected to the supported portion 45. The small pieces 44D, 44E extend to the second side of the width direction DW1 and bend in a radial inner direction of the first axis X40.

The contact member 40 is assembled to the support portion 34 as described below.

As illustrated in FIG. 10, the contact member 40 in a posture in which the extending portion 43 faces upward is inserted shallowly into the support shaft 34A so that the support shaft 34A engages with the second end portion 40S2 of the torsion coil spring 40S as illustrated in FIG. 11A. In this state, the small pieces 44D, 44E are located closer to an end of the supplying tray 3 on the first side of the width direction DW1 than the stopper pieces 34D, 34E.

Next, the contact member 40 is swung in a counterclockwise direction of the paper of FIG. 11B against an urging force of the torsion coil spring 40S as illustrated in FIG. 11B to thereby move the small pieces 44D, 44E to positions not overlapping the stopper portions 34D, 34E when viewed from the width direction DW1.

Next, the contact member 40 is deeply inserted into the support shaft 34A to move the small pieces 44D, 44E to a position closer to an end of the supplying tray 3 on the second side of the width direction DW1 than the stopper pieces 34D, 34E, then, the contact member 40 is swung in a clockwise direction of the paper in FIGS. 11A and 11B by the urging force of the torsion coil spring 40S.

As a result, an upper end of the second contact portion 42 comes into contact with the contacted portion 33, and the contact member 40 is positioned in a circumferential direction of the first axis X40 as illustrated in FIG. 7. The small pieces 44D, 44E are located at positions overlapping the stopper pieces 34D, 34E when viewed from the width direction DW1 in this state to thereby prevent the supported portion 45 from slipping off from the support shaft 34A.

As described above, the contact member 40 is supported by the pressure plate body 32 so as to be movable between a first position at which the upper end of the second contact portion 42 is in contact with the contacted portion 33 as illustrated in FIG. 7 and a second position at which the upper end of the second contact portion 42 is spaced apart from the contacted portion 33 downward and frontward as illustrated in FIG. 13. The torsion coil spring 40S urges the contact member 40 so that the upper end of the second contact portion 42 comes into contact with the contacted portion 33 illustrated in FIG. 7.

The positions of the contact member 40 illustrated in FIG. 2, FIG. 3, FIG. 8, FIG. 9, FIG. 12, and FIG. 14, that is, a position of the contact member 40 at which the upper end of the second contact portion 42 is in contact with the contacted portion 33 correspond to the first position.

Lifting/Lowering Mechanism

As illustrated in FIG. 2 and FIG. 3, the image forming apparatus 1 includes a lifting/lowering mechanism 6 configured to move the pressure plate 31 in the up and down direction between the non-supply position and the supply position.

The lifting/lowering mechanism 6 includes a transmission shaft 69 extending in the width direction DW1. A first end of the transmission shaft 69 in the width direction DW1 is coupled to a not-illustrated drive source and a transmission mechanism, though not illustrated. The transmission shaft 69 pivots in the counterclockwise direction of the paper in FIG. 7 when a drive force from the not-illustrated drive source and the transmission mechanism is transmitted.

As illustrated in FIG. 2 and FIG. 3, the lifting/lowering mechanism 6 has two pairs of transmission gears 68 and lifting/lowering arms 60. The lifting/lowering arm 60 is an example of a "lifting/lowering member" according to the present disclosure.

The transmission gear 68 and the lifting/lowering arm 60 of a first pair of the two pairs are located on a rear side of the contact member 40 which is located on the first side of the width direction DW1. The transmission gear 68 and the lifting/lowering arm 60 of a second pair of the two pairs are located on a rear side of the contact member 40 located on the second side of the width direction DW1.

The transmission gear 68 and the lifting/lowering arm 60 of the first pair and the transmission gear 68 and the lifting/lowering arm 60 of the second pair have the same configuration and disposed symmetrically opposite to each other. Accordingly, the configuration of the transmission gear 68 and the lifting/lowering arm 60 of the first pair will be explained in detail, and the explanation for the transmission gear 68 and the lifting/lowering arm 60 of the second pair is omitted.

The transmission gear 68 is a sector gear, which is pivotable together with the transmission shaft 69. The transmission gear 68 is urged by an extension coil spring 68S so as to pivot in the clockwise direction of the paper in FIG. 7. The transmission gear 68 pivots together with the transmission shaft 69 in the counterclockwise direction of the paper in FIG. 7 when a drive force from a not-illustrated drive source and a transmission mechanism is transmitted to the transmission shaft 69.

As illustrated in FIG. 2 and FIG. 3, the lifting/lowering arm 60 is swingable about a second axis X60 extending in the width direction DW1 at a position in front of the transmission shaft 69. The lifting/lowering arm 60 has a sector gear 62, an arm portion 63, and an operating portion 64. The sector gear 62 is an example of a "gear" according to the present disclosure. The arm portion 63 is an example of a "protrusion" or an "arm" according to the present disclosure. The operation portion 64 is an example of a "contacted surface" according to the present disclosure.

The sector gear 62 has a plurality of gear teeth arranged in an arc shape about the second axis X60. The sector gear 62 is engaged with the transmission gear 68.

The arm portion 63 extends in a radial outer direction of the second axis X60 and in the front direction. The operating portion 64 is formed on a distal end side of the arm portion 63. The operating portion 64 is located below the first contact portion 41 of the contact member 40 and contactable with the first contact portion 41.

When the transmission gear 68 pivots in the counterclockwise direction of the paper in FIG. 7, the arm portion 63 is swung to a position at which the arm portion 63 is inclined downward in the front direction. At this time, when the operating portion 64 is lowered while being in contact with the contact member 40 of the pressure plate 31 from below, the pressure plate body 32 of the pressure plate 31 is lowered and the operating portion 64 is spaced apart from the contact member 40 downward.

On the other hand, when the transmission gear 68 pivots in the clockwise direction of the paper in FIG. 8, the arm portion 63 is swung to a position at which the arm portion 63 is inclined upward in the front direction. At this time, the operating portion 64 lifts the pressure plate body 32 of the pressure plate 31 in a state in which the operating portion 64 is in contact with the contact member 40 of the pressure plate 31 from below.

As described above, the lifting/lowering arm 60 is movable so as to move the pressure plate 31 in the up and down direction.

The image forming apparatus 1 has a positional relationship in a normal state in which the pressure plate 31 is located upper than the lifting/lowering arms 60 and the lifting/lowering arms 60 are located lower than the pressure plate 31 as illustrated in FIG. 2, FIG. 3 and FIG. 7 to FIG. 9. Here, an up-and-down relationship between the pressure plate 31 and the lifting/lowering arm 60 is a positional relationship between a downstream-end side of the pressure plate 31 in the supplying direction DF1 and the operating portion 64 of the lifting/lowering arm 60.

However, when the pressure plate 31 moves in the up and down direction in the image forming apparatus 1, for example, in a case where the sheet SH jammed at the time of supplying is removed, in a case where operations are suddenly stopped at the time of supplying due to a power outage, and in other cases, there is a possibility that the pressure plate body 32 of the pressure plate 31 in the non-supply position enters an area lower than the operating portion 64 of the lifting/lowering arm 60 and that the positional relationship in the normal state in which the pressure plate 31 is located upper than the lifting/lowering arm 60 is reversed as illustrated in FIG. 12. That is, there is a possibility that the positional relationship in the normal state is changed to a positional relationship in an abnormal state in which the pressure plate 31 is located lower than the lifting/lowering arm 60.

It is noted that a position of the lifting/lowering arm 60 illustrated by a dashed and double dotted line in FIG. 12 is a position at which the lifting/lowering arm 60 is lifted to the highest position by an urging force of the extension coil spring 68S in a state in which the transmission shaft 69 is not limited by a not-illustrated transmission mechanism when a front cover constituting the front surface 9S of the housing 9 is opened for removing the jammed sheet SH.

Operations of Contact Member in Positional Relationship where Pressure Plate is Located Upper than Lifting/Lowering Arm In the case of the positional relationship in the normal state in which the pressure plate 31 is located upper than the lifting/lowering arm 60, when the lifting/lowering arm 60 is lifted for moving the pressure plate 31 from the non-supply position to the supply position as illustrated in FIG. 8 and FIG. 9, the first contact portion 41 comes into contact with the operating portion 64 of the lifting/lowering arm 60 in a state in which the contact member 40 is at the first position at which the upper end of the second contact portion 42 is in contact with the contacted portion 33. Accordingly, the contact member 40 is pushed up with the pressure plate body 32. As a result, the pressure plate 31 moves to the supply position.

Moreover, in the case of the positional relationship in the normal state in which the pressure plate 31 is located upper than the lifting/lowering arm 60, when the lifting/lowering arm 60 is lowered for moving the pressure plate 31 from the supply position illustrated in FIG. 8 and FIG. 9 to the non-supply position illustrated in FIG. 7 and the like, the contact member 40 is lowered with the pressure plate body 32 while the first contact portion 41 is in contact with the operating portion 64 of the lifting/lowering arm 60 in a state in which the contact member 40 is at the first position at which the upper end of the second contact portion 42 is in contact with the contacted portion 33 and. When the pressure plate 31 is moved to the non-supply position and stops, the first contact portion 41 also stops and is separated from the operating portion 64 which is lowering.

Operation of Contact Member when Positional Relationship at which Pressure Plate is Located Upper than Lifting/Lowering Arm is Reversed The contact member 40 operates as described below in a case where the pressure plate body 32 of the pressure plate 31 in the non-supply position enters the area lower than the operating portion 64 of the lifting/lowering arm 60 and the positional relationship in the normal state in which the pressure plate 31 is located upper than the lifting/lowering arm 60 is reversed, that is, the positional relationship is changed from the normal state to the abnormal state as illustrated in FIG. 12.

That is, when the lifting/lowering arm 60 moves from a position higher than the pressure plate 31 toward a position lower than the pressure plate 31, the operating portion 64 of the lifting/lowering arm 60 is lowered while being in contact with the first contact portion 41 from above as illustrated in FIG. 13; therefore, a pressing force in a downward direction is applied on the first contact portion 41.

Accordingly, the contact portion 40 is swung in the counterclockwise direction of the paper of FIG. 13 against the urging force of the torsion coil spring 40S. That is, the contact member 40 moves to the second position at which the contact member 40 is escaped from the lifting/lowering arm 60 in accordance with the contact with the lifting/lowering arm 60. Accordingly, the lifting/lowering arm 60 can be lowered without being interfered with by the first contact portion 41 of the contact member 40.

Then, when the operating portion 64 of the lifting/lowering arm 60 is spaced downward apart from the first contact portion 41 and the lifting/lowering arm 60 is moved to a position lower than the pressure plate 31, the contact member 40 is swung in the clockwise direction of the paper in FIG. 7 by the urging force of the torsion coil spring 40S and moved to the first position as illustrated in FIG. 7.

Operation of Guiding Portion

Figure 14:
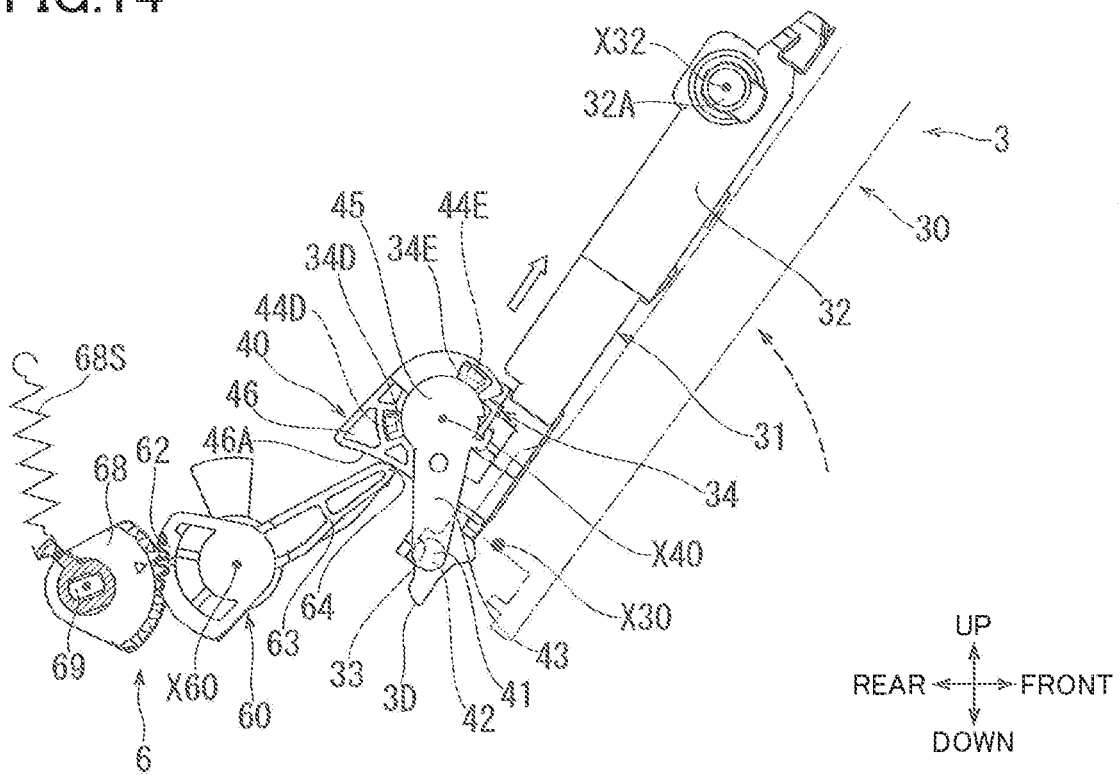
FIG. 14 is a side view similar to FIG. 7, which is a view for explaining an operation of a guiding portion of the contact member when the supplying tray moves from the extended position to the accommodated position.

In the case where the positional relationship in which the pressure plate 31 is located upper than the lifting/lowering arm 60 is reversed, that is, in the case where the lifting/lowering arm 60 is located upper than the pressure plate 60, as illustrated in FIG. 12, when the supplying tray 3 moves from the extended position to the accommodated position as illustrated in FIG. 14, the guiding portion 46 operates as described below.

That is, an apex of the guiding portion 46 moves above the operating portion 64 of the lifting/lowering arm 60 which has been lifted. Then, the guiding surface 46A guides the lifted lifting/lowering arm 60 to a position lower than the guiding portion 46 while being in slide-contact with the operating portion 64 of the lifted lifting/lowering arm 60.

At this time, a pressing force applied on the guiding surface 46A from the operating portion 64 applies so as to slide the pivoting shafts 32A, 32B of the pressure plate body 32 toward the first rail ends 36A1, 36B1 of the link rails 36A, 36B. As a result, the supplying tray 3 can be moved to the accommodated position smoothly.

Effects

In the image forming apparatus 1 according to Embodiment 1, there is a possibility that the positional relationship in which the pressure plate 31 is located upper than the lifting/lowering arm 60 is reversed as illustrated in FIG. 12, for example, when the pressure plate moves in the up and down direction in the case where the sheet SH jammed at the time of supplying is removed, in the case where the operations are suddenly stopped at the time of supplying due to the power outage, and in other cases.

In this point, the pressure plate 31 includes the pressure plate body 32 and the contact members 40 in the image forming apparatus 1. That is, the pressure plate 31 is divided into the plurality of parts. Then, when the lifting/lowering arm 60 is moved from the position higher than the pressure plate 31 to the position lower than the pressure plate 31 for returning the positional relationship between the pressure plate 31 and the lifting/lowering arm 60 from the positional relationship in the abnormal state to the original positional relationship in the normal state, as illustrated in FIG. 13, the contact member 40 moves to the second state in accordance with the contact with the lifting/lowering arm 60 and escapes from the lifting/lowering arm 60. As a result, the lifting/lowering arm 60 can reach the position lower than the pressure plate 31 without being interfered with by the contact member 40, and the abnormality can be solved as the contact member 40 moves to the first position after that.

Accordingly, even when the positional relationship in which the pressure plate 31 is located upper than the lifting/lowering arm 60 is reversed, the relationship can be returned to the original relationship, and it is possible to suppress damage of the pressure plate 31 or the lifting/lowering arm 60 in the image forming apparatus 1 according to Embodiment 1.

Also in the image forming apparatus 1, the pressure plate 31 includes the torsion coil spring 40S disposed between the pressure plate body 32 and the contact member 40 and the torsion coil spring 40S urges the contact member 40 toward the first position as illustrated in FIG. 10, FIG. 11A and FIG. 11B. According to the configuration, the contact member 40 is urged by the torsion coil spring 40S, and the upper end of the second contact portion 42 is limited to move by the contacted portion 33 of the pressure plate body 32; therefore, the contact member 40 is held at the first position with high reliability. Moreover, the contact member 40 can be returned to the first position with high reliability after moving to the second position in accordance to the contact with the lifting/lowering arm 60.

Moreover, the contact member 40 in the image forming apparatus 1 includes the first contact portion 41 and the second contact portion 42 protruding from the first contact portion 41 toward the pressure plate body 32 side in the width direction DW1 as illustrated in FIG. 9. That is, the first contact portion 41 and the second contact portion 42 are adjacent to each other in the width direction DW1. Accordingly, it is possible to suppress transmission loss of a force transmitted from the lifting/lowering arm 60 which is lifted for moving the pressure plate from the non-supply position to the supply position to the pressure plate body 32.

In the image forming apparatus 1, the contact member 40 includes the supported portion 45 and the extending portion 43. Then, the first contact portion 41 is located on the distal end side of the extending portion 43, and the second contact portion 42 is adjacent to the first contact portion 41 on the distal end side of the extending portion 43. Accordingly, the first contact portion 41 and the second contact portion 42 can be simplified, and thus, bulkiness of the contact member 40 in the width direction DW1 can be suppressed in the image forming apparatus 1. As a result, it is possible to suppress increase in size of the image forming apparatus 1 in the width direction DW1.

Furthermore, the contact member 40 is supported by the pressure plate body 32 so as to be swingable about the first axis X40 extending tin the width direction DW1 as illustrated in FIG. 7 and FIG. 13 in the image forming apparatus 1. Accordingly, bulkiness of the contact member 40 in the width direction DW1 can be suppressed, as a result, it is possible to suppress increase in size in the width direction DW1 in the image forming apparatus 1.

Also in the image forming apparatus 1, the lifting/lowering arm 60 includes the sector gear 62, the arm portion 63, and the operating portion 64, and the lifting/lowering arm 60 is swingable about the second axis X60. According to the configuration, when the lifting/lowering arm 60 moves from the position higher than the pressure plate 31 toward the position lower than the pressure plate 31, the contact member 40 can move to the second position smoothly in accordance with the contact with the operating portion 64 of the lifting/lowering arm 60 and can be escaped from the lifting/lowering arm 60 positively. As a result, it is possible to suppress damage of the lifting/lowering arm 60.

Additionally, in the image forming apparatus 1, the contact member 40 includes the guiding portion 46 as illustrated in FIG. 14. Then, when the supplying tray 3 moves from the extended position to the accommodated position, the apex of the guiding portion 46 moves above the operating portion 64 of the lifting/lowering arm 60 which has been lifted. Then, the guiding surface 46A guides the lifted lifting/lowering arm 60 to a position lower than the guiding portion 46 while being in slide-contact with the operating portion 64 of the lifted lifting/lowering arm 60.

As a result, it is possible to suppress the reversal of positional relationship in which the pressure plate 31 is located upper than the lifting/lowering arm 60 when the supplying tray 3 moves from the extended position to the accommodated position in the image forming apparatus 1.

Furthermore, each of the link rails 36A, 36B has the drawing-shape portions 36C in the image forming apparatus 1 as illustrated in FIG. 5. Accordingly, when the supplying tray 3 moves from the accommodated position to the extended position, fall-off of the pressure plate 31 can be suppressed by resistance given to the pivoting shafts 32A, 32B by the drawing-shape portions 36C. As a result, it is possible to suppress the pressure plate 31 from slipping to an area below the lifting/lowering arm 60 and possible to suppress impact noise caused by fall-off of the pressure plate 31 in the image forming apparatus 1.

Embodiment 2

Figure 15:
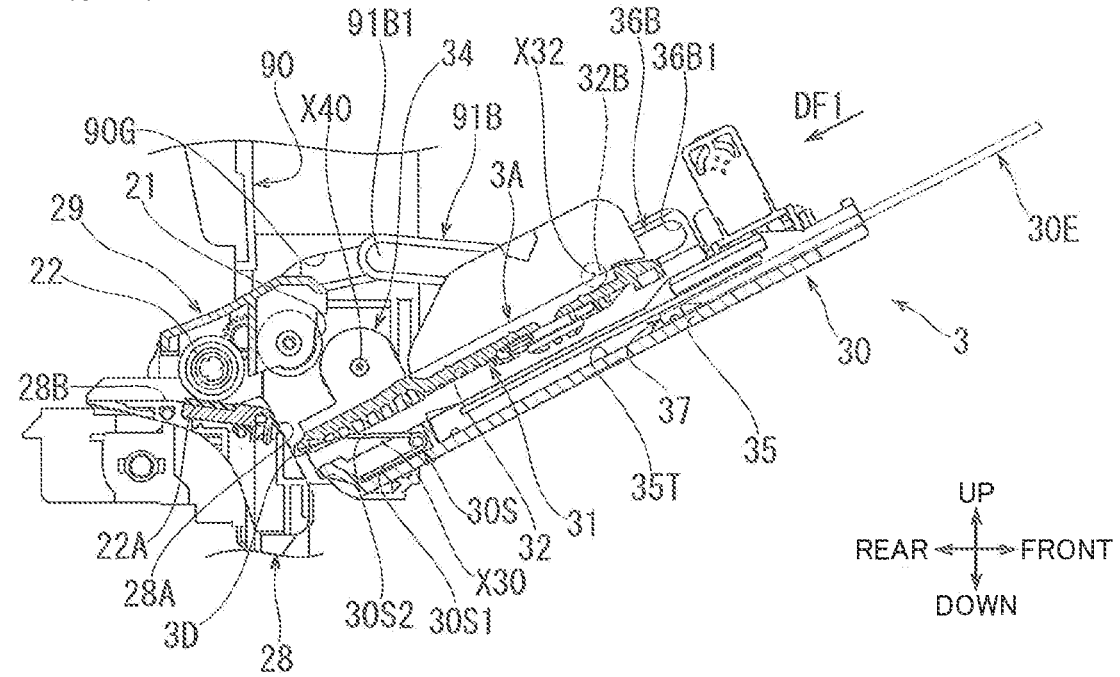
FIG. 15 is a partial cross-sectional view relating to an image forming apparatus according to Embodiment 2 and similar to FIG. 1, which is a view chiefly illustrating a state in which a torsion coil spring urges the pressure plate in a direction directed from the non-supply position toward the supply position.
Figure 16:
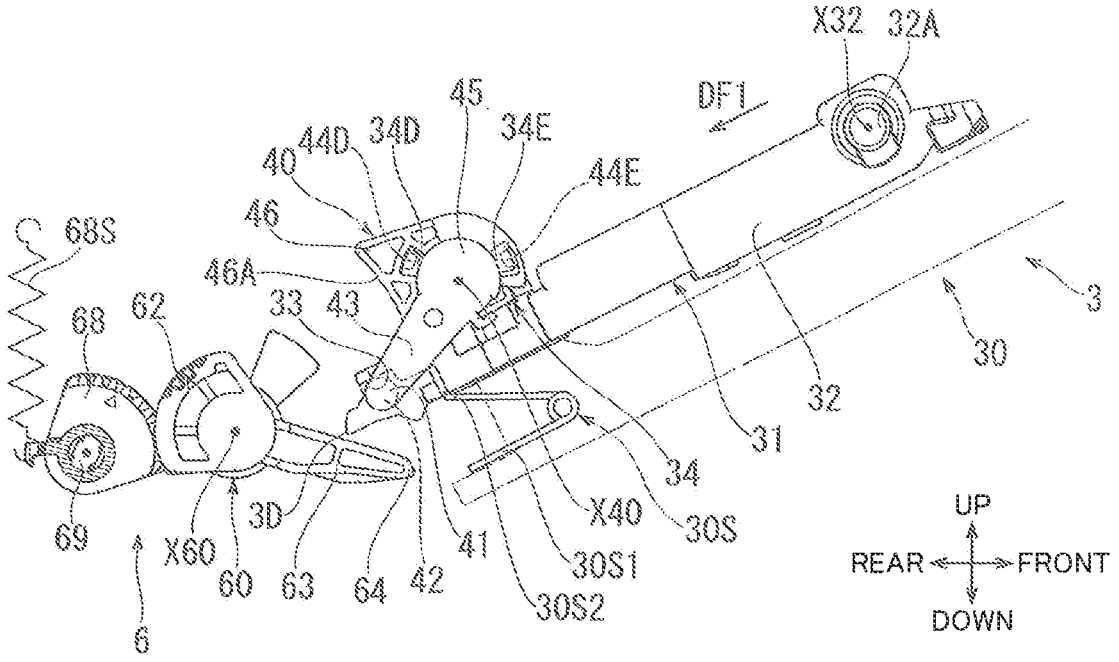
FIG. 16 is a side view relating to the image forming apparatus according to Embodiment 2 and similar to FIG. 7, which is a view chiefly illustrating a state in which the torsion coil spring urges the pressure plate in the direction directed from the non-supply position toward the supply position.

As illustrated in FIG. 15 and FIG. 16, the supplying tray 3 includes a torsion coil spring 30S in an image forming apparatus according to Embodiment 2. The torsion coil spring 30S is an example of a "second urging member" in the present disclosure.

A first end portion 30S1 of the torsion coil spring 30S is engaged with a downstream end of the inner surface 35T of the supplying tray body 30 in the supplying direction DF1. A second end portion 30S2 of the torsion coil spring 30S protrudes so as to be spaced apart from the inner surface 35T as going downstream of the supplying direction DF1, and the second end portion 30S2 is in contact with the pressure plate body 32 from below.

The second end portion 30S2 of the torsion coil spring 30S is in contact with the center of the pressure plate body 32 in the width direction DW1 from below, though not illustrated.

The torsion coil spring 30S urges the pressure plate 31 in the direction directed from the non-supply position to the supply position by pressing the pressure plate body 32 upward.

Other configurations of Embodiment 2 are the same as those of Embodiment 1. Accordingly, the same symbols are added to the same configurations as Embodiment 1 and explanation is omitted or simplified.

Effects

In the image forming apparatus according to Embodiment 2, the torsion coil spring 30S changes a distance from the non-supply position to a position of the pressure plate 31 when the pressure plate 31 comes close to the supply position in accordance with the quantity in the number of the sheets SH supported by the supplying tray 3, namely, increase/decrease in weight of the sheet SH. Then, when the pressure plate 31 moves in the up and down direction, for example, in the case where the sheet SH jammed at the time of supplying is removed, in the case where the operations are suddenly stopped at the time of supplying due to a power outage, and in other cases, the number of sheets SH supported by the supplying tray 3 is generally zero or extremely low. Accordingly, the distance from the non-supply position to the position of the pressure plate 31 when the pressure plate 31 urged by the torsion coil spring 30S so that the pressure plate 31 comes close to the supply position becomes large. As a result, it is possible to suppress the reversal of the positional relationship in which the pressure plate 31 is located upper than the lifting/lowering arm 60 when the pressure plate 31 moves in the up and down direction in the image forming apparatus.

When the supplying tray 3 moves from the accommodated position to the extended position in the image forming apparatus, the second end portion 30S2 of the torsion coil spring 30S gives resistance to the pressure plate body 32 of the pressure plate 31, which is about to fall, in a state in which the second end portion 30S2 is in slide-contact with the pressure plate body 32 while the second end portion 30S2 applies the urging force on the pressure plate body 32. As a result, it is possible to suppress impact noise caused by fall-off of the pressure plate 31 in the image forming apparatus.

The present disclosure has been explained according to Embodiments 1, 2 as above. The present disclosure is not limited to the above Embodiments 1, 2 and may of course be applied by being suitably modified in a scope not departing from the gist thereof.

The contact member 40 swings about the first axis X40 extending in the width direction DW1 in Embodiments 1, 2; however, the present disclosure is not limited to the configuration. For example, the contact member 40 may swing about a swing axis extending in the supplying direction and may move between a first position and a second position which is lower than the first position and closer to the center of the supplying tray than the first position in the width direction. The contact member 40 may also directly move in the width direction of the supplying tray and may move between a first position and a second position which is the same height as the first position and closer to the center of the supplying tray than the first position in the width direction.

The present disclosure can be used for an image forming apparatus, an image reading apparatus, a multifunction device, and so on.

What is claimed is:

1. A sheet supplying apparatus, comprising:

a supplying roller configured to supply a sheet;

a supply tray supporting the sheet and including a pressure plate movable between a supply position at which an uppermost sheet in the supply tray is caused to be brought into contact with the supplying roller and a non-supply position which is lower than the supply position; and a lifting/lowering member having a gear and a protrusion protruding from the gear, the lifting/lowering member being configured to move so as to move the pressure plate in a state in which the protrusion of lifting/lowering member is in contact with the pressure plate from below, wherein the pressure plate includes:

a pressure plate body supporting the sheet; and a contact member supported by the pressure plate body so as to be movable between a first position and a second position, the contact member being pushed up with the pressure plate body while being in contact with the protrusion of the lifting/lowering member at the first position when the protrusion of the lifting/lowering member is lifted for moving the pressure plate from the non-supply position to the supply position in a state in which the protrusion of the lifting/lowering member is placed below the pressure plate body, the contact member being lowered with the pressure plate body while being in contact with the protrusion of the lifting/lowering member at the first position when the lifting/lowering member is lowered for moving the pressure plate from the supply position to the non-supply position in the state in which the lifting/lowering member is placed below the pressure plate body, wherein in a state where the protrusion of the lifting/lowering member is at a position higher than the pressure plate, the contact member is configured to move to the second position where the contact member is pushed away by the lifting/lowering member in accordance with the contact with the protrusion of the lifting/lowering member as the protrusion of the lifting/lowering member moves from the position higher than the pressure plate toward a position lower than the pressure plate, and wherein the contact member is configured to move to the first position when the lifting/lowering member moves to the position lower than the pressure plate.

2. The sheet supplying apparatus according to claim 1, wherein the first position of the contact member is a position at which a contact portion of the contact member is in contact with a contacted portion of the pressure plate.

3. The sheet supplying apparatus according to claim 2, wherein the second position of the contact member is a position at which the contact portion of the contact member is spaced apart from the contacted portion of the pressure plate.

4. The sheet supplying apparatus according to claim 1, wherein the pressure plate includes a first urging member disposed between the pressure plate body and the contact member and configured to urge the contact member toward the first position.

5. The sheet supplying apparatus according to claim 1, wherein the contact member includes:

a first contact portion brought into contact with the lifting/lowering member from below when the lifting/lowering member is lifted for moving the pressure plate from the non-supply position toward the supply position, and a second contact portion protruding from the first contact portion toward the pressure plate body of the supplying tray in a width direction, an upper end of the second contact portion coming into contact with the pressure plate body from below when the first contact portion is brought into contact with the lifting/lowering member from below.

6. The sheet supplying apparatus according to claim 5, wherein the contact member includes:

a supported portion supported by the pressure plate body so as to be swingable about a first axis extending in the width direction of the supplying tray, and an extending lever extending from the supported portion in a radial direction of the first axis, wherein the first contact portion is located on a distal end side of a center of the extending lever, and wherein the second contact portion is adjacent to the first contact portion on the distal end side of the extending lever.

7. The sheet supplying apparatus according to claim 1, wherein the contact portion is supported by the pressure plate body so as to be swingable about a first axis extending in the width direction of the supplying tray.

8. The sheet supplying apparatus according to claim 1, wherein the gear of the lifting/lowering member is a sector gear having a second axis extending in the width direction of the supplying tray as a center, wherein the protrusion is an arm extending in the radial direction of the second axis from the sector gear, the arm having a contacted surface formed on a distal end side of a center of the arm and contactable with the contact member.

9. The sheet supplying apparatus according to claim 1, further comprising a housing, wherein the supplying tray is supported by the housing so as to be movable between an accommodated position at which the supplying tray stands along a side surface of the housing and an extended position at which the supplying tray extends in a direction intersecting the side surface so as to support the sheet, and wherein the contact member includes a guiding portion configured to guide the lifted lifting/lowering member to a position lower than the contact member while the guiding portion is in slide-contact with the lifting/lowering member when the supplying tray moves from the extended position to the accommodated position.

10. The sheet supplying apparatus according to claim 1, further comprising:

a housing; and a link arm, a first end of which is coupled to the housing, wherein the pressure plate body includes a pivoting shaft having a third axis extending in the width direction of the supplying tray as a center and supported at a second end of the link arm, wherein the supplying tray includes a link rail configured to guide the pivoting shaft, the supplying tray being supported by the housing so as to be movable between (a) a accommodated position at which the supplying tray stands along a side surface of the housing when the pivoting shaft is guided to a first rail end of the link rail and (b) an extended position at which the supplying tray extends in a direction intersecting the side surface so as to support the sheet when the pivoting shaft is guided to a second rail end, which is on an opposite side of the first rail end, of the link rail, and wherein the link rail has a drawing-shape portion configured to give resistance to the pivoting shaft which moves from the first rail end to the second rail end.

11. The sheet supplying apparatus according to claim 1, wherein the supplying tray includes a second urging member configured to urge the pressure plate in a direction directed from the non-supply position to the supply position.

12. A sheet supplying apparatus, comprising:

a supplying roller configured to supply a sheet;

a supply tray supporting the sheet and including a pressure plate movable between a supply position at which an uppermost sheet in the supply tray is caused to be brought into contact with the supplying roller and a non-supply position which is lower than the supply position;

a gear; and a protrusion protruding from the gear, the protrusion being configured to move so as to move the pressure plate in a state in which the protrusion is in contact with the pressure plate from below, wherein the pressure plate includes:

a pressure plate body supporting the sheet;

a disk supported by the pressure plate body;

a spring disposed between the pressure plate body and the disk; and an extending lever extending from the disk in a radial direction of the first axis so as to be movable between a first position and a second position, the spring being configured to urge the extending lever toward the first position, the extending lever being pushed up with the pressure plate body while being in contact with the protrusion at the first position when the protrusion is lifted for moving the pressure plate from the non-supply position to the supply position in a state in which the protrusion is placed below the pressure plate body, the extending lever being lowered with the pressure plate body while being in contact with the protrusion at the first position when the protrusion is lowered for moving the pressure plate from the supply position to the non-supply position in the state in which the protrusion is placed below the pressure plate body, wherein in a state where the protrusion is at a position higher than the pressure plate, the extending lever is configured to move to the second position where the extending lever is pushed away by the protrusion as the protrusion moves from the position higher than the pressure plate toward a position lower than the pressure plate, and wherein the spring is configured to urge the extending lever to the first position when the protrusion moves to the position lower than the pressure plate.

13. The sheet supplying apparatus according to claim 12, wherein the first position of the protrusion is a position at which the extending lever is in contact with a contacted portion of the pressure plate.

14. The sheet supplying apparatus according to claim 13, wherein the second position of the protrusion is a position at which the extending lever is spaced apart from the contacted portion of the pressure plate.

15. The sheet supplying apparatus according to claim 12, wherein the extending lever includes:

a first contact area brought into contact with the protrusion from below when the protrusion is lifted for moving the pressure plate from the non-supply position toward the supply position, the first contact area is located on a distal end side of a center of the extending lever, and a second contact portion protruding from the first contact area toward the pressure plate body of the supplying tray in a width direction, an upper end of the second contact portion coming into contact with the pressure plate body from below when the first contact area is brought into contact with the protrusion from below, the second contact portion is adjacent to the first contact area on the distal end side of the extending lever.

* * * * *